US005934967A

United States Patent [19]

Brown et al.

[11] Patent Number: 5,934,967

[45] Date of Patent: Aug. 10, 1999

[54] SELF-ACTUATING SPREADING APPARATUS

[75] Inventors: Douglas M. Brown, Monterey; Larry G. Lynch, Los Gatos; James M. Hair, III, San Ramon, all of Calif.

[73] Assignee: Blue Leaf Design, Inc., Monterey, Calif.

[21] Appl. No.: 08/904,717

[22] Filed: Jul. 31, 1997

[51] Int. Cl.[6] ..... A63H 27/00; B64C 3/38

[52] U.S. Cl. ..... 446/62; 446/68; 244/46

[58] Field of Search ..... 446/62, 61, 64, 446/66, 68; 135/25.32, 22; 244/39, 46

[56] References Cited

U.S. PATENT DOCUMENTS

| | | | |
|---|---|---|---|
| 2,074,897 | 3/1937 | Everts | 446/62 X |
| 2,599,957 | 6/1952 | Walker | 446/68 |
| 2,744,698 | 5/1956 | Baynes | 244/46 |
| 3,001,747 | 9/1961 | Hockett | 446/68 X |
| 3,662,974 | 5/1972 | Peterson | 244/46 X |
| 4,194,317 | 3/1980 | Kidd | 446/68 |
| 4,915,664 | 4/1990 | Bakker | 446/62 |
| 5,035,378 | 7/1991 | Spanovich | 244/46 X |
| 5,766,055 | 6/1998 | Kimi et al. | 446/62 |

FOREIGN PATENT DOCUMENTS

| | | | |
|---|---|---|---|
| 588207 | 5/1925 | France | 446/62 |
| 2227950 | 8/1990 | United Kingdom | 446/62 |

*Primary Examiner*—Robert A. Hafer
*Assistant Examiner*—D. Neal Muir
*Attorney, Agent, or Firm*—Lyon & Lyon LLP

[57] ABSTRACT

An apparatus which transforms itself from one form to another. The apparatus comprises a body having a first rotatable leg and a second rotatable leg mounted thereon. When placed in motion, the apparatus is in its first form. First and second links are rotatably mounted in the first and second rotatable legs, respectively. The first and second links are pivotably joined at a pivot point. The apparatus has a weight disposed at the pivot point. Forces acting on the apparatus at different stages of travel cause forces to shift. This causes rotation of the first rotatable leg and said second rotatable leg. When this occurs, the apparatus is transformed into the second form. Also, a center of gravity shifting apparatus shifts the center of gravity of the apparatus from the front of the apparatus to the rear of the apparatus.

10 Claims, 12 Drawing Sheets

SELF-ACTUATING SPREADING APPARATUS

BACKGROUND OF THE INVENTION

1. Field of the Invention

This invention relates generally to self-actuating spreading or opening apparatus and more specifically relates to flying apparatus which converts from one form of flight to another form of flight at an apogee.

2. Description of the Prior Art

Toy flying apparatuses are well known in the prior art. There are two basic types of flying toys. The first type involves a missile-like craft in which the structure is launched with a launcher. After a launch, the craft travels quickly toward an apogee. At an apogee, the craft immediately falls back down toward the ground, as there is no motive force or any type of wing to maintain flight. The second type of prior art flying toy is a glider-like craft. The glider-like craft is typically launched by a launcher or is simply thrown into flight by a user. After launch, the glider-like craft flies at low speed for a substantial period of time. Unlike the missile-like craft, the glider-like craft does not immediately fall to the ground.

The present invention combines the exciting long range travel of the missile-like craft (i.e., rapid climb toward an apogee), with the long flight time of the glider-like craft, thereby resulting in a flying apparatus that exceeds the performance of the prior art. Such a toy would be launched like a missile and could travel at relatively high speeds until reaching its apogee and then upon reaching its apogee or shortly thereafter transform itself into a glider-like toy and then fly through the air at low speeds. In addition, it has long been desired to be able to vary the type of flight maintained by the toy when performing as a glider-like toy.

SUMMARY OF THE INVENTION

The present invention overcomes the problems and disadvantages of the prior art by providing a flying apparatus which transforms itself from one form into another form. The present invention utilizes the inertia of a weight disposed in a movable portion of an apparatus to transform the apparatus, when in motion, from one form to another.

In one aspect of the present invention, such an apparatus comprises a body which can be placed in motion. This body comprises a first rotatable leg and a second rotatable leg mounted thereon. When this apparatus is placed in motion, the apparatus is in its first form. First and second links are rotatably mounted in the first and second rotatable legs, respectively. The first and second links are pivotably joined at a pivot point. The apparatus has a weight disposed at the pivot point.

In another embodiment, the present invention comprises a central spar having a head piece affixed at a first axial end thereof. A first and second dogleg link are rotatably mounted in the head piece. First and second head links are rotatably mounted in a deflected portion of the first and second dogleg link. The first and second head links are pivotably mounted to each other at a pivot point. Disposed in the pivot point is a head weight. A first wing spar is connected to the first dogleg link and a second wing spar connected to the second dogleg link. A first wing link and a second wing link are pivotably mounted to the first wing spar and second wing spar, respectively. A sliding cage is slidably mounted on the central spar. The sliding cage has the first wing link and said second wing link pivotably mounted thereon.

In the various embodiments of the present invention, the transformable flying apparatus can have the sliding cage mounted to the central spar by a cage extension. The position of the fulcrum on the central spar is adjustable by moving a fulcrum holder in an adjustment slot disposed in the central spar. A leg having an aft weight disposed at one end thereof is slidably mounted in a tube pivot mounted on the sliding cage. Furthermore, in the various embodiments of the present invention a tensile element actuator can be connected between said sliding cage and an anchor point on the central spar.

The above and other preferred features of the invention, including various novel details of implementation and combination of elements will now be more particularly described with reference to the accompanying drawings and pointed out in the claims. It will be understood that the particular methods and apparatus embodying the invention are shown by way of illustration only and not as limitations of the invention. As will be understood by those skilled in the art, the principles and features of this invention may be employed in various and numerous embodiments without departing from the scope of the invention.

BRIEF DESCRIPTION OF THE DRAWINGS

Reference is made to the accompanying drawings in which are shown illustrative embodiments of aspects of the invention, from which novel features and advantages will be apparent.

DETAILED DESCRIPTION OF THE DRAWINGS

Turning to the figures, the presently preferred apparatus and methods of the present invention will now be described.

Figure 1:
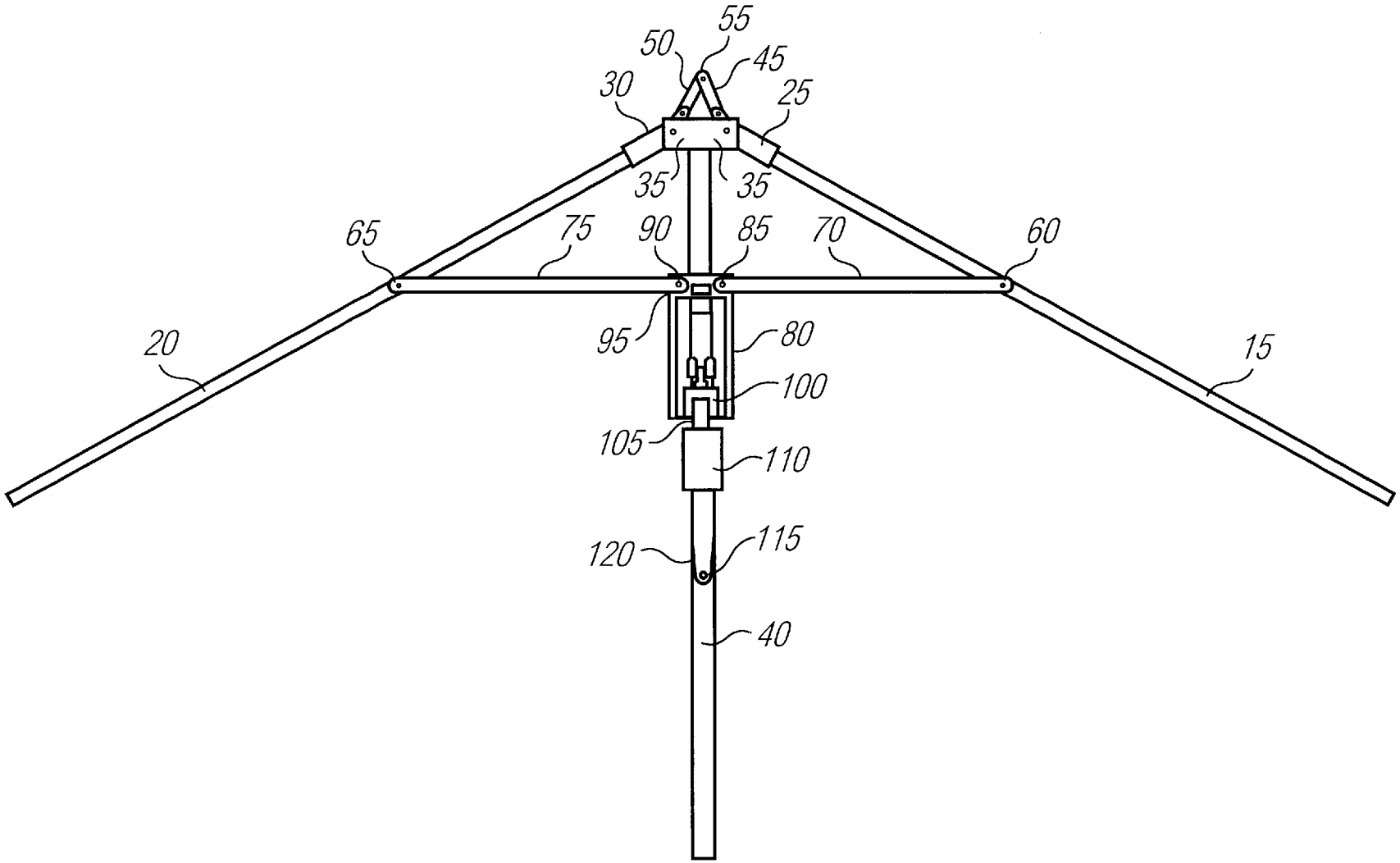
FIG. 1 is a bottom view of a wing spreading apparatus constructed in accordance with aspects of the present invention with wing spars disposed in an open position.
Figure 2:
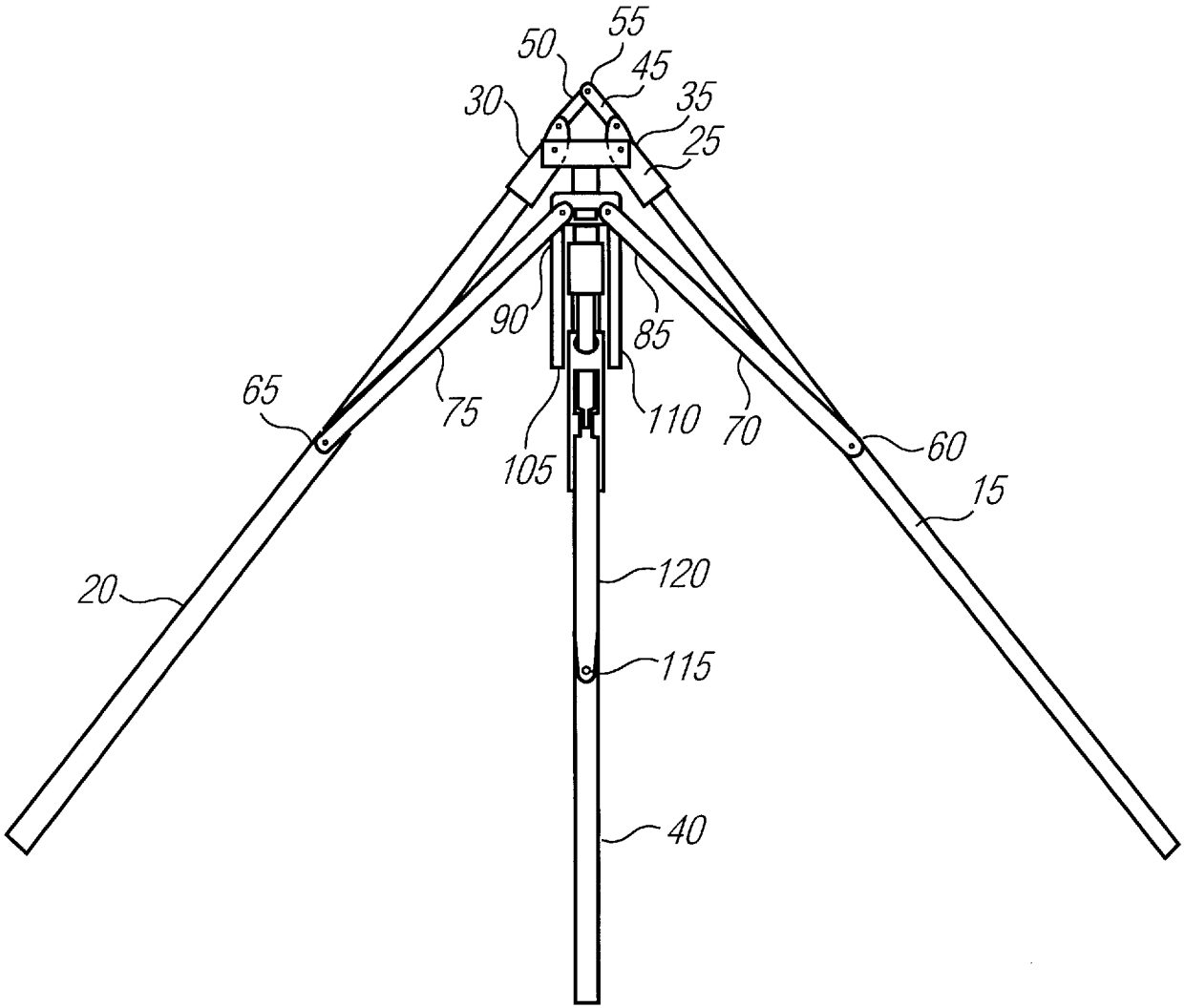
FIG. 2 is a bottom view of a wing spreading apparatus constructed in accordance with aspects of the present invention with wing spars disposed approximately midway between an open position and closed position.
Figure 3:
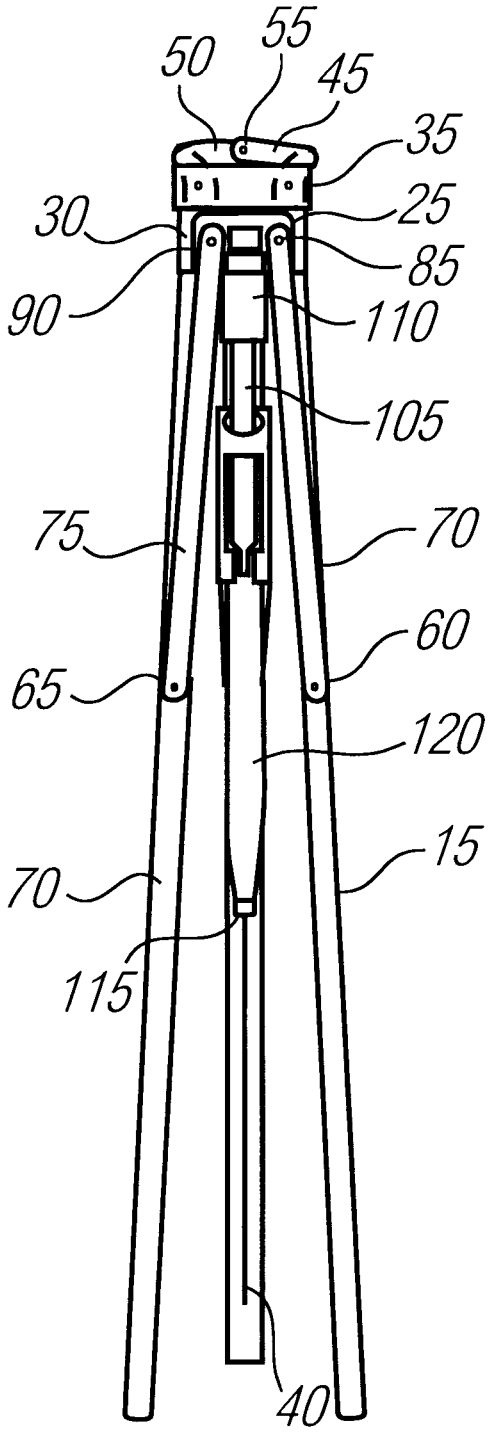
FIG. 3 is a bottom view of a wing spreading apparatus constructed in accordance with aspects of the present invention with wing spars disposed in a closed position.
Figure 6:
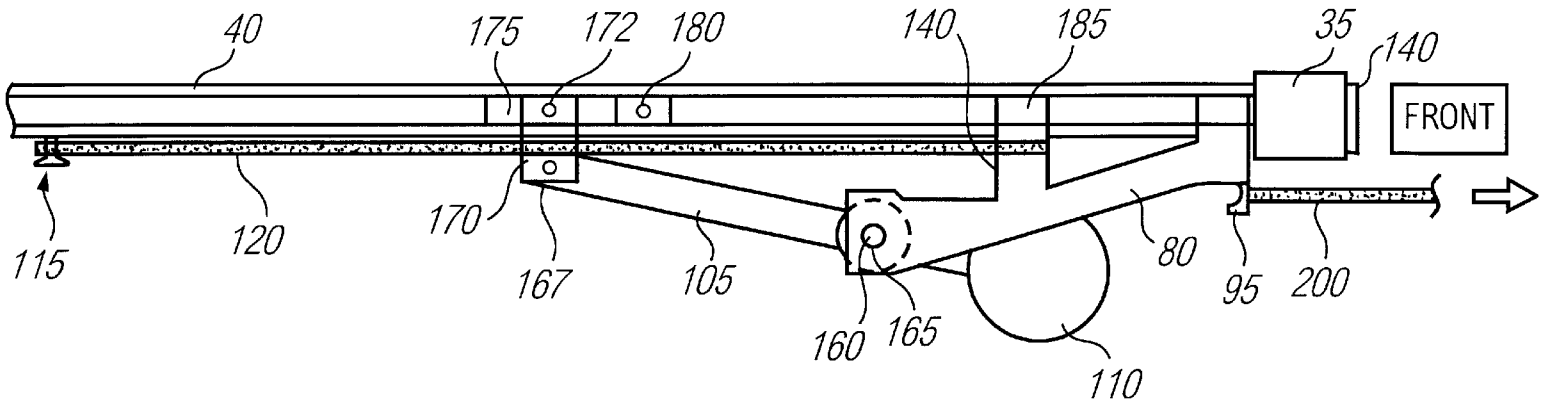
FIG. 6 is a side view of a wing spreading apparatus constructed in accordance with aspects of the present invention with a sliding cage in a first position and an aft weight in a first position.
Figure 6A:
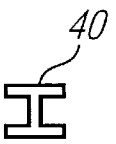
FIG. 6*a* is a cross-sectional view of a central spar constructed in accordance with the present invention.

The basic structure of the apparatus of the present invention can be seen with reference to FIGS. 1–3. FIGS. 1–3 show the apparatus with its wings at varying degrees of spread. As seen in FIG. 1, the apparatus comprises two separate wing spars: first wing spar 15 and second wing spar 20. The first wing spar 15 is inserted into a first dogleg link 25 while the second wing spar 20 is inserted into a second dogleg link 30. The first dogleg link 25 and second dogleg link 30 are pivotably mounted within a head piece 35. The head piece 35 is fixed to a central spar 40. Central spar 40 extends essentially the entire axial length of the craft. In the presently preferred embodiments, central spar 40 comprises an I-beam cross-section (see FIG. 6*a*). The first dogleg link 25 is pivotably mounted to a first head link 45 while the second dogleg link 30 is pivotably mounted to a second head link 50. Each of the first and second head links 45 and 50 are pivotably fastened to each other at fastened first pivot point 55. Centrally located on the first wing spar 15 is a second pivot point 60. Likewise, centrally located on the second wing spar 20 is a third pivot point 65.

Pivotably mounted to the second pivot point 60 is a first wing link 70. Pivotably mounted to the third pivot point 65 is a second wing link 75. First wing link 70 and second wing link 75 are also pivotably mounted to sliding cage 80 at a fourth pivot point 85 and a fifth pivot point 90, respectively. Sliding cage 80 is slidably mounted on the central spar 40 such that when it moves through different positions on the central spar 40, the first and second wing spars 15, 20 are moved either closer to the central spar or father from the central spar. Specifically, when sliding cage 80 is moved toward head piece 35, fourth pivot point 85 and fifth pivot point 90 also move toward head piece 35. This causes first wing link 70 and second wing link 75 to rotate about the fourth and fifth pivot points 85, 90 respectively. This causes wing link 70 to pull first wing spar 15 toward the central spar 40. It also causes wing link 75 to pull second wing spar 20 toward the central spar 40.

Figures 10, 11, 12, 13:
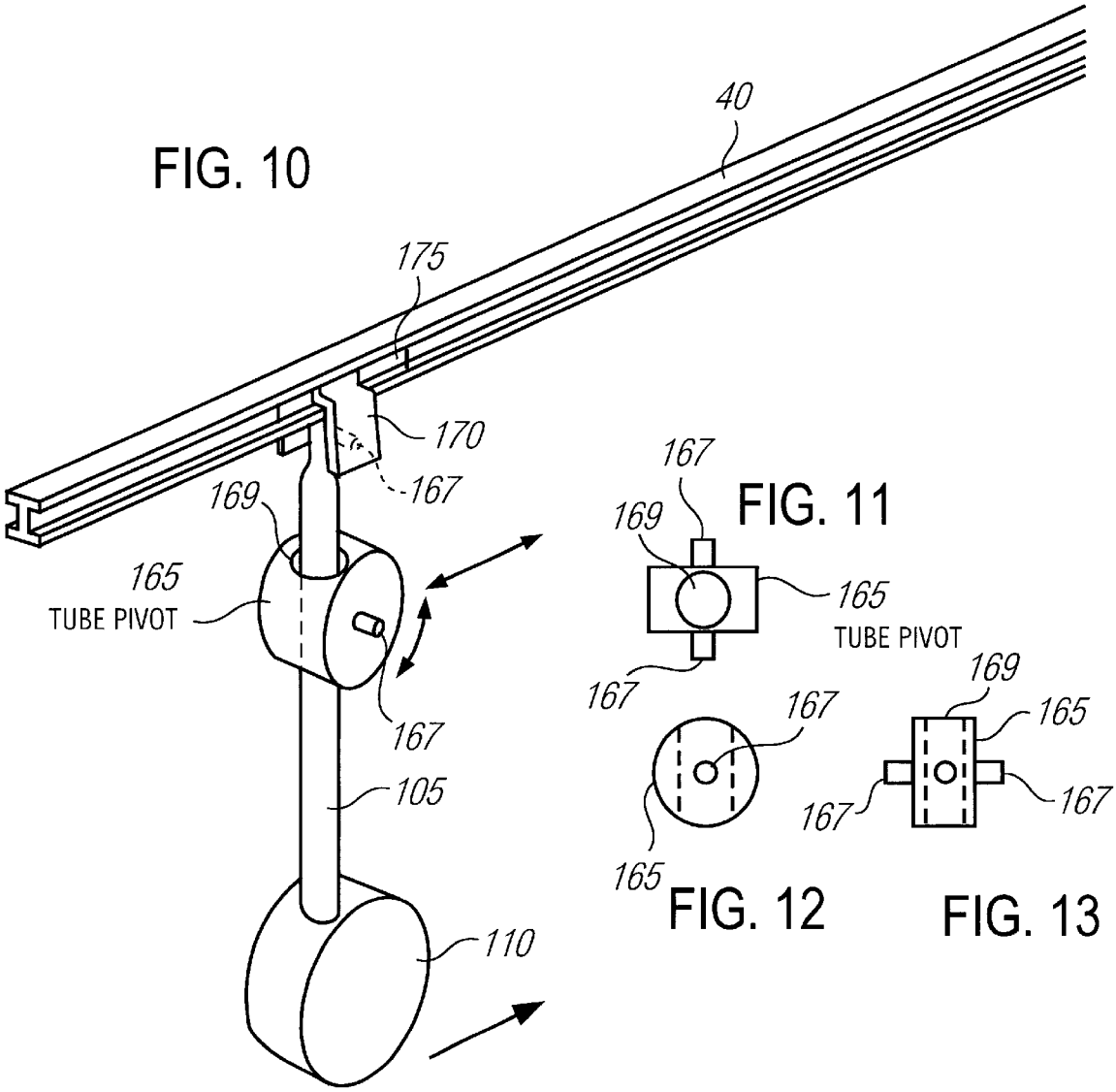
FIG. 10 is a perspective view of a center of gravity shifting apparatus constructed in accordance with aspects of the present invention.
FIG. 11 is a top view of a tube pivot apparatus constructed in accordance with aspects of the present invention with an aperture exposed.
FIG. 12 is a side view of a tube pivot apparatus constructed in accordance with aspects of the present invention.
FIG. 13 is an alternate top view of a tube pivot apparatus constructed in accordance with aspects of the present invention showing hidden lines of an aperture that passes through the tube pivot.

Thus, as it is seen in FIG. 3, the closer the sliding cage 80 is to the head piece 35, the closer the first wing spar 15 and second wing spar 20 are toward central spar 40, e.g., when sliding cage 80 is pulled all the way toward head piece 35, the first wing spar 15 and second wing spar 20 are substantially adjacent to the central spar 40. When the first wing spar 15 and second wing spar 20 are in this position, as will be discussed below, the apparatus will function as a missile-like craft during flight. Also fastened to the sliding cage 80 is a hook 95 which, as will be discussed below, is used to attach a launching apparatus. A tube pivot 100 is disposed at a proximal end of the sliding cage 80. Slidably and rotatably mounted within the tube-pivot 100 is a leg 105 (see FIG. 10). An aft weight 110 is affixed to the end of leg 105 which is opposite the tube pivot 100. As will be discussed below, the position of aft weight 110, which is determined by the position of leg 105 and sliding cage 80, is used to shift the center of gravity of the craft to positions which are advantageous for the type of flight which the craft is engaged in.

Also located on the central spar 40 is an anchor point 115. Prior to launching of the craft, an actuator will be connected to first anchor point 115 and a second anchor point 190 (see FIGS. 6–9). In the presently-preferred embodiments, actuator 120 can be a rubber band or other elastic apparatus capable of providing a tensile force between two points. When the craft is in the closed position (see, e.g., FIG. 3) the actuator 120 will be fully extended, as is apparent in FIG. 3. The tensile force of the actuator 120, and hence the type of actuator 120 used in the craft, is selected such that the apparatus can be maintained in the closed position when no other forces (i.e., gravity, weight, etc.) are applied.

As will be discussed below, after reaching an apogee, the forces acting on the apparatus (see below) shift. This shifting is such that the tensile force provided by the actuator 120, in combination with other forces acting on the craft, is stronger than the forces holding the first and second wing spars 15 and 20 in the closed position. This will cause the actuator 120 to pull the sliding cage 80 toward the anchor point 115. When this occurs, the sliding cage 80 pulls back first wing link 70 and second wing link 75 at fourth pivot point 85 and fifth pivot point 90, respectively. This can be seen in FIGS. 2–3. As the first wing link 70 and second wing link 75 moves back toward the anchor point 115, the first wing spar 15 and second wing spar 20 are pushed away from the central spar 40. The sliding cage 80 will continue to move back toward the anchor point 115 until the sliding cage 80 reaches cage stop 180, and the apparatus reaches a fully open position, which is seen in FIG. 1. The wings of the craft are formed of panels of cloth, sheet plastic materials or the like. The Figures do not show these panels so that the drawings can be simplified and to allow for better views of the structure of the craft of the present invention.

Figure 4:
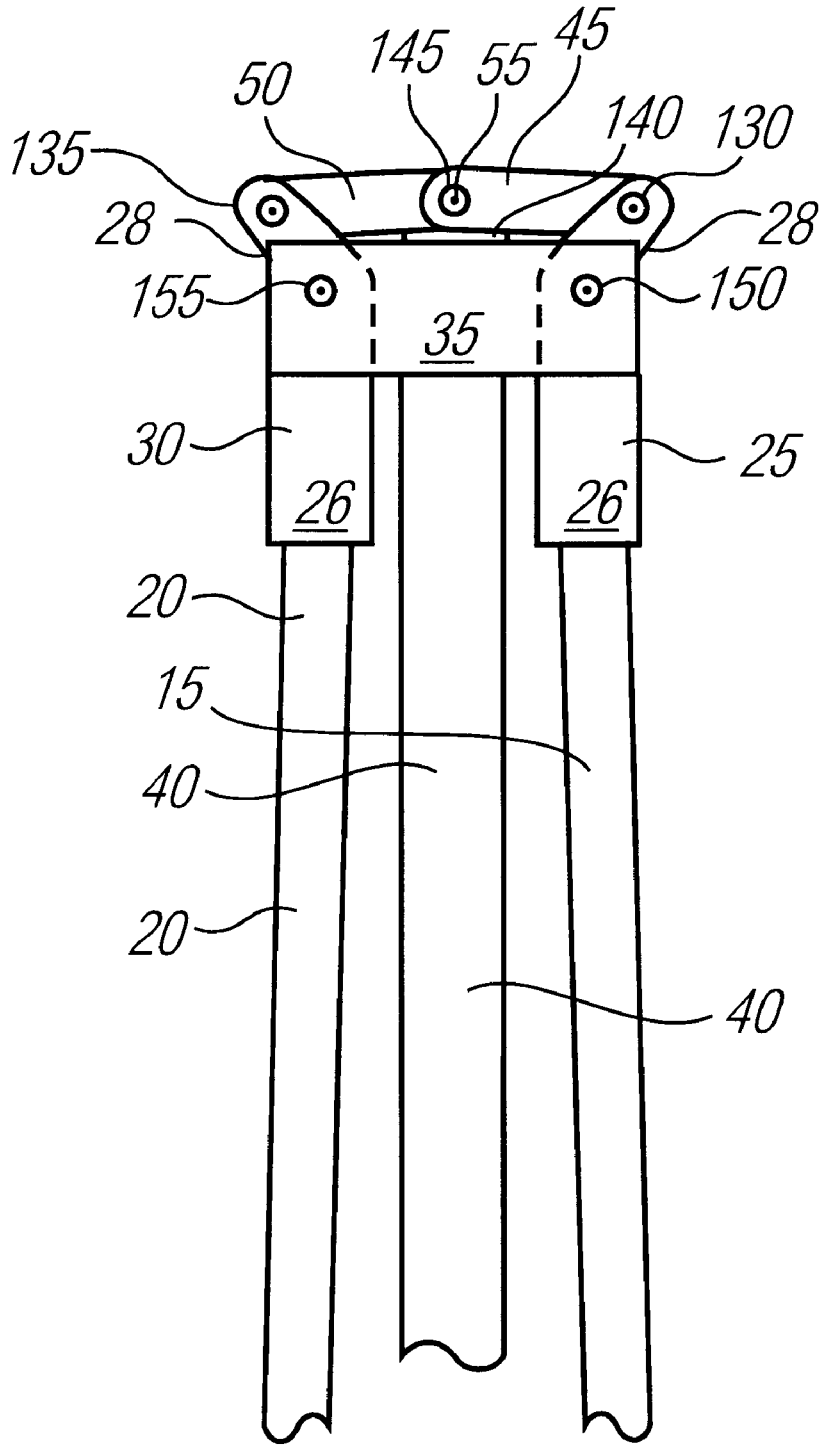
FIG. 4 is a magnified bottom view of the frontal portion of an embodiment constructed in accordance with aspects of the present invention.
Figure 5:
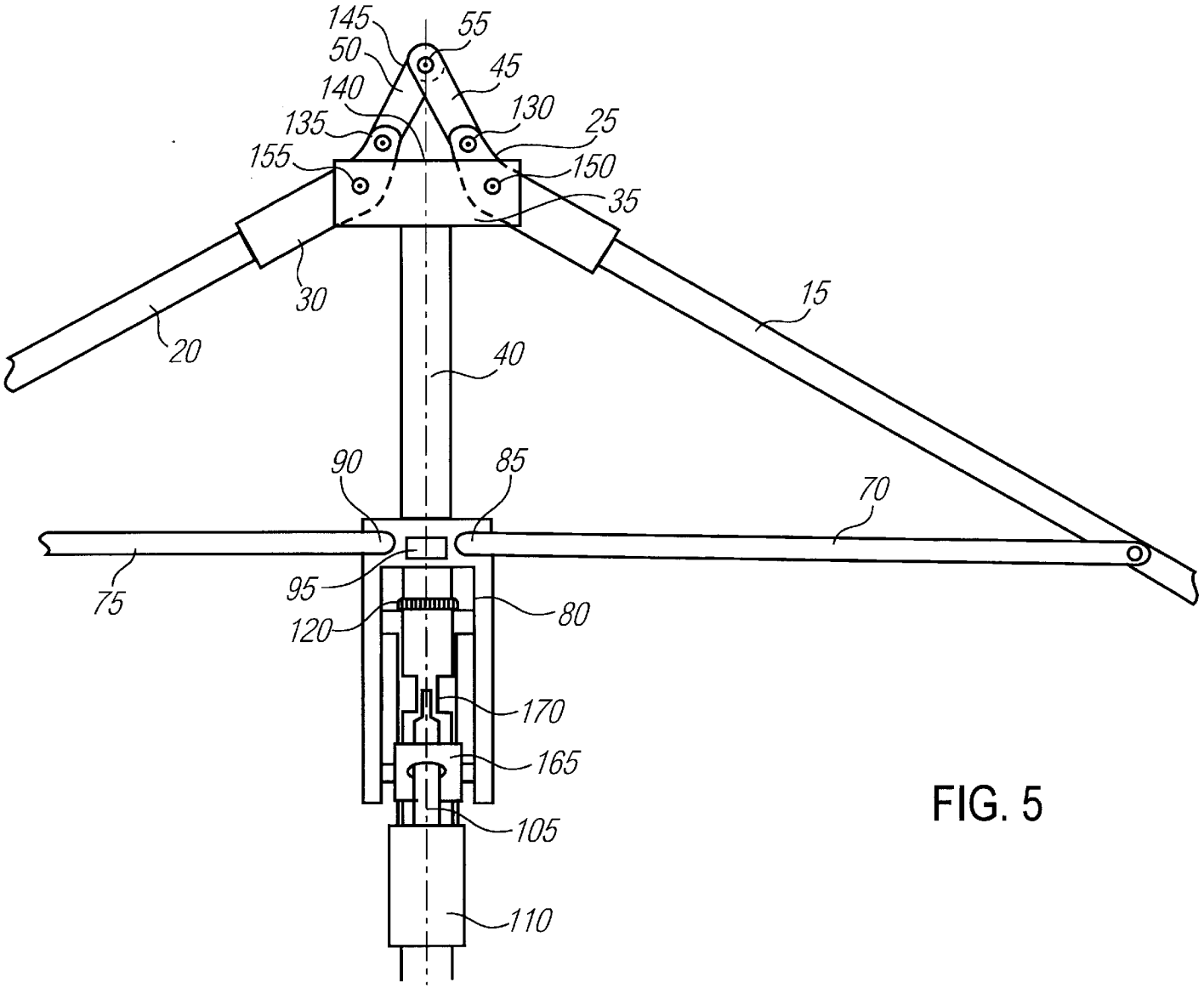
FIG. 5 is a magnified view of a wing spreading apparatus constructed in accordance with aspects of the present invention with wing spars disposed in an open position.
Figure 5A:
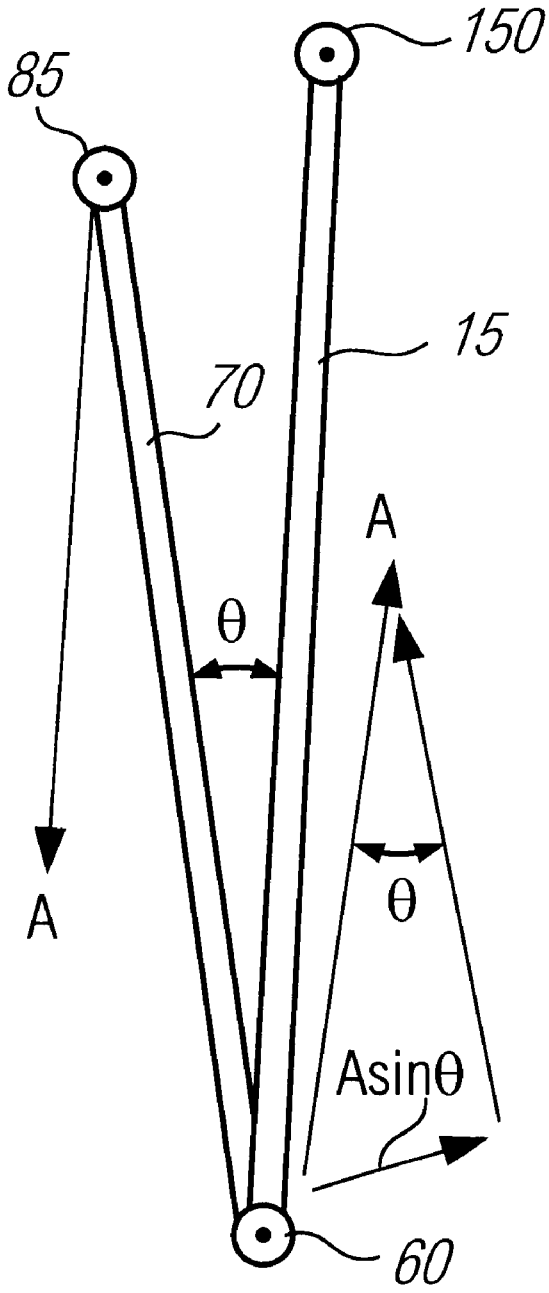
FIG. 5*a* is a schematic diagram showing the forces present at various locations of the wing spreading apparatus of the present invention.

With reference to FIGS. 4, 5 and 5*a*, a more detailed view of the fore portion of the craft is shown to allow a more detailed discussion of the wing spreading apparatus of the present invention. The first dogleg link 25 and second dogleg link 30 are each comprised of a central body 26 and a deflected portion 28. Disposed in the deflected portion 28 is the sixth pivot point 130 and seventh pivot point 135. A first head link 45 is rotatably mounted in the sixth pivot point 130 located in the deflected portion 28 of first dogleg link 25. Likewise, a second head link 50 is rotatably mounted in the seventh pivot point 135 located in the deflected portion 28 of second dogleg link 30. First head link 45 and second head link 50 are joined at first pivot point 55 such that first head link 45 and second head link 50 can move, thereby moving first pivot point 55 either toward the head piece 35 or away from the head piece 35, depending on the position of the first wing spar 15 and second wing spar 20.

It is important to note that fourth pivot point 85 must be located closer to the central axis (or centerline) of the central spar 40 than is the eighth pivot point 150. Likewise, fifth pivot point 90 must be located closer to the central axis of the central spar 40 than is ninth pivot point 155. The reason for this is seen with reference to FIG. 5*a*. Specifically, if the force A (shown as vector A in FIG. 5*a*) is applied to fourth pivot point 85 by the actuator 120, there will be a smaller component force (A)SIN Θ, which is pushing second pivot point 60 outwards.

When first wing spar 15 and second wing spar 20 are brought toward central spar 40, i.e., first wing spar 15 and second wing spar 20 are located substantially adjacent to central spar 40, the sixth pivot point 130 and seventh pivot point 135 separate relative to each other (see, e.g., FIG. 4). This is due to the positioning of the deflected portion 28 of first dogleg link 25 and second dogleg link 30. When first wing spar 15 and second wing spar 20 are brought toward central spar 40, first pivot point 55 is brought toward a surface 140. Surface 140 can comprise the fore portion of central spar 40, or it can comprise an additional structure. In a presently preferred embodiment, surface 140 is the distal portion of the central spar 40. Importantly, when the first head link 45 and second head link 50 are in contact with surface 140, first pivot point 55 is disposed such that it is slightly above the plane located between the sixth pivot point 130 and the seventh pivot point 135. The surface 140 is carefully located such that the first head link 35 and second head link 50 rest on it, thereby maintaining the first pivot point 55 at a position slightly deflected from that plane. When the first head link 35 and the second head link 50 are in this position, a substantial force would be required to separate the first wing spar 15 and second wing spar 20 relative to the central spar 40. The tensile force provided by actuator 120 does not exceed this force.

Disposed in pivot point 55 is a head weight 145. Head weight 145 may be a metal (or other dense material) rivet, or other fastener, which can rotatably fasten the first head link 45 and second head link 50 together, as well as act as the inertial mass of the apparatus. In comparison to the first wing spar 15 and second wing spar 20, first head link 45 and second head link 50 are relatively free to move away from surface 140, depending on other forces acting on the entire apparatus. Such forces would include gravity or inertia.

In use, the user will connect a launching device to the hook 95 located on the sliding cage 80. This launching device (not shown) can be as simple as a rubber band or other elastic structure. To launch the craft, the first wing spar 15 and second wing spar 20 are placed such that they are substantially adjacent to central spar 40. As discussed, this will cause sliding cage 80 to move toward head piece 35. This will cause the actuator 120 to extend, thereby placing tensile force between the anchor point 115 and the sliding cage 80. When the craft is in this position it will look as it does in FIGS. 3 and 4. Furthermore, as also discussed, the first pivot point 55 will be brought such that the first head link 45 and second head link 50 are resting on surface 140.

When the craft is launched by the user, the head weight 145 is accelerated upward. The inertia of the head weight 145 during launch (i.e., the head weight 145 tends to stay at a rest) causes the first head link 45 and second head link 50 to be forced against surface 140. As discussed, first pivot point 55 is at a position slightly deflected from that plane formed between sixth pivot point 130 and the seventh pivot point 135. During the craft's climb toward apogee, the force due to gravity, the force due to aerodynamic drag, and the friction of the hinges used at second, third, fourth, fifth, sixth, seventh, eighth, and ninth pivot points 60, 65, 85, 90, 130, 135, 150, 155 act to maintain the craft such that the first wing spar 15 and second wing spar 20 are maintained in the closed position and such that first head link 45 and second head link 50 are forced against surface 140. A force counter to these forces is the force caused by the inertia of the head weight 145. Specifically, the inertia of the head weight 145 is such that head weight 145 attempts to move at the velocity at which the craft was moving prior to the deceleration caused by the aerodynamic and gravitational forces. During the climb towards apogee, however, the force caused by the inertia is overcome by the gravitational forces, the aerodynamic forces and the frictional forces.

Once the craft was launched at some angle other than perpendicular to the horizon (i.e., straight up), when the craft reaches apogee, all of the forces discussed above except for the inertial force drop to zero. Also, as the craft reaches apogee, and hence the angle becomes such that the craft becomes parallel to the horizon, the vector of the gravitational force starts to point away from the center of the craft. At this point, the only force which is maintaining the craft in its closed position is the frictional forces caused by the hinges in the second, third, fourth, fifth, sixth, seventh, eighth, and ninth pivot points 60, 65, 85, 90, 130, 135, 150, 155. Once the craft passes apogee and is positioned such that the front of the craft begins to point slightly downward (i.e., toward the ground), the gravitational force begins to act in addition to the inertial force on the head weight 145 and acts to pull the first pivot point 55 away from surface 140. At this point, the actuator 120 then pulls the sliding cage 80 from the front of the craft to the rear of the craft. Thus, it is the shifting of the gravitational force from where it is pulling the head weight 145 toward surface 140, to where it is pulling head weight 145 away from surface 140 that shifts the balance and causes the first wing spar 15 and second wing spar 20 to move to the open position.

With first pivot point 55 moving away from surface 140, the first head link 45 and second head link 50 pull the deflected portions 28 of first dogleg link 25 and second dogleg link 30 in toward the axis of the central spar 40. Because first dogleg link 25 is rotatably mounted to first wing spar 15 at sixth pivot point 130, and because second dogleg link 30 is rotatably mounted to to second wing spar 20 at seventh pivot point 135, first dogleg link 25 and second dogleg link 30 rotate about eighth pivot point 150 and ninth pivot point 155 in an arcuate motion. Because the first wing spar 15 and second wing spar 20 are fastened to first dogleg link 25 and second dogleg link 30, respectively, the first wing spar 15 and second wing spar 20 move in an arcuate fashion from their closed position to their open position.

As discussed, when the combination of gravity and inertia cause the head weight 145 to move away from surface 140, thereby causing the first head link 45 and second head link 50 to move forward, the tensile force of the actuator 120 acts to pull the sliding cage 80 toward the aft (or rear) of the craft. When the sliding cage 80 moves toward the aft of the craft, fourth pivot point 85 and fifth pivot point 90 move away from the head piece 35, which forces second pivot point 60 and third pivot point 65 away from the central spar 40. By moving first wing link 70 and second wing link 75 in this manner, the first wing spar 15 and second wing spar 20 rotate about eighth pivot point 150 and ninth pivot point 155 respectively, and are therefore moved away from the central spar 40. Once the first wing spar 15 and second wing spar 20 are fully opened, the first wing link 70 and second wing link 75 act to maintain the position of first wing spar 15 and second wing spar 20.

Other methods of using the inertia of head weight 145 to pull first head link 45 and second head link 50 away from surface 40 is to either suddenly stop the craft or suddenly slow down the craft. When the craft is suddenly stopped or suddenly slowed down, the inertia of the head weight 145 will cause it to continue to move in the direction it was moving prior to either stopping or slowing down. This is caused by the inertia of head weight 145. This initial force will cause the first pivot point 55 to continue to move away from the surface 140. This will cause first head link 45 and second head link 50 to move away from surface 40, which will force the deflected portions of first dogleg link 25 and second dogleg link 30 to rotate about eighth pivot point 150 and ninth pivot point 155, respectively. This will result in the first pivot point 55 moving away from surface 140.

Another method of moving first pivot point 55 away from surface 140 even if the craft is stationary will now be discussed. The first wing spar 15 and second wing spar 20 are placed such that they are substantially adjacent to central spar 40, i.e. the craft is in a closed position. Then, the craft is positioned such that the central spar 40 is in a substantially vertical position with respect to the horizon and pivot point 140 is at a higher altitude than the surface 140 (i.e., the craft is facing upwards). The craft is rotated in a downward position, i.e., first pivot point 55 is moved such that it is at a lower altitude than surface 140. Gravity will cause the head weight 140 to move away form surface 140, thereby causing the first head link 45 and second head link 50 to move away from the surface 140. This will cause the first wing spar 15 and second wing spar 20 to move to the open position.

Thus, it is seen that the concepts of the present invention are not limited to the application of flying apparatuses. Any apparatus which can be placed in motion can utilize the concepts of the present invention. For example, a moving body that has its velocity changed during its travel can utilize the concepts of the present invention to cause a change in its appearance. For example, a moving body that is slowed down during travel could have articles such as flags or the like become exposed or waved.

When the craft is being launched and therefore behaving as a missile-like craft, it is desirable to have the center of gravity of the craft as close to its front as possible to keep the craft from tumbling in flight. However, when the craft is behaving as a glider, it is desirable to have the center of gravity centrally located under the wing area of the craft, as close to the center of lift as possible. The mechanism of the present invention for enabling the center of gravity of the craft to shift from the front of the craft during take off to a central area of the wingspan is described with reference to FIGS. 6–13. As is seen in FIGS. 6–13, and in particular with reference to FIG. 6, the sliding cage 80 is extended such that it is as far to the front of the craft as possible. As will be discussed, by moving the sliding cage 80 toward the front of the craft, the aft weight 110 is moved such that it is in close proximity to the front of the craft. The aft weight 110 is fixedly mounted to a leg 105. Leg 105 slides freely through an aperture 169 in tube pivot 165. Side and top views of tube pivot 165 can be seen with reference to FIGS. 11–13. Pins 167 are mounted in apertures 160 (only one of which is shown) located in an axial extension of sliding cage 80, thereby rotatably mounting tube pivot 165 therein. At the end of the leg 105 opposite the aft weight 110 is mounted are pins 167 which are rotatably mounted within a fulcrum 170. The fulcrum 170 has two walls surrounding the lower flange of the central spar and fits into an adjustment slot 175 that is disposed within the recess of the central spar 40 (as discussed, the central spar 40 comprises an I-beam like structure). Adjustment slot 175 forms an aperture in central spar 40 that fulcrum 170 can pass through. Fulcrum 170 has a tightening apparatus 172 that fixes the position of the fulcrum 170 within the adjustment slot 175 once the position of the fulcrum 170 is selected. Also located within the recess of the central spar 40 is a permanently mounted cage stop 180. When the sliding cage 80 is pulled toward the rear of the craft by the actuator 120, a mounting portion 185 of the sliding cage (i.e., that portion of the sliding cage which is located within the recess of the central spar 40), strikes one side of the cage stop 180. This maintains the sliding cage 80 in the position such that the first wing spar 15 and second wing spar 20 are fully spread and the sheet wing material (not shown) is fully extended. When the sliding cage 80 is moved toward the front of the craft (i.e., the craft is in a take off position), the front portion of the sling cage 80 either strikes head piece 35 or becomes substantially adjacent the head piece 35.

The operation of the center of gravity shifting apparatus will now be discussed. At launching, a launching apparatus 200 such as a rubber band (see FIG. 6) is placed upon the hook 95 located on sliding cage 80. This pulls the sliding cage 80 toward the front of the craft. When the sliding cage 80 is moved to the front of the craft, it is in a first, or launching, position. When this occurs, actuator 120 which is wrapped around anchor point 115 and a central portion 190 of the sliding cage 80 increases its tensile force between the anchor point 115 and the central portion 190. In addition, by moving the sliding cage 80 forward, the aft weight 110 located at one end of the leg 105 swings into a recess (not shown in FIG. 6–9) of the sliding cage 80. This shifts the center of gravity of the craft toward the front of the craft. The motion of leg 105 is accomplished by having leg 105 rotate about the fulcrum 170 and slide through tube pivot 165, the tube pivot 165 then rotating about apertures 160. In addition, moving the sliding cage 80 to the first position causes first wing link 70 and second wing link 75 to rotate about fourth pivot point 85 and fifth pivot point 90, respectively. When this occurs, first wing link 70 pulls first wing spar 15 toward central spar 40 and second wing link 75 pulls second wing spar 20 toward central spar 40. This motion causes first dogleg link 25 and second dogleg link 30 to rotate about eighth pivot point 150 and ninth pivot point 155, respectively. As discussed this action moves first head link 45 and second head link 50 toward surface 140.

For reasons discussed above, head weight 145 moves away from surface 140. This causes first head link 45 and second head link 50 to rotate about sixth pivot point 130 and seventh pivot point 135, respectively. This rotation causes the adjacent portions 28 of first dogleg link 25 and second dogleg link 30 to be pulled inward toward the axis of central spar 40. This causes first dogleg link 25 to rotate about eighth pivot point 150 and second dogleg link 30 to rotate about ninth pivot point 155. This moves the first wing spar 15 and the second wing spar 20 away from central spar 40. This causes first wing spar 15 to pull first wing link 70 and second wing spar 20 to pull second wing link 75. This causes first wing link 70 and second wing link 75 to pull sliding cage 80 back toward the rear of the craft.

In addition to these forces, when the sliding cage begins to move toward the rear of the craft, the tensile force created by actuator 120 also begins to pull the sliding cage 80 toward the rear of the craft. The tensile force applied by actuator 120 causes the sliding cage 80 toward the rear of the craft. It also increases the speed of this motion, thereby decreasing the amount of time it takes to transform the craft from a missile-like craft into a glider-like craft.

Thus, it is seen that in a presently preferred embodiment, there are three separate forces acting on the craft to transform it from a missile-like craft into a glider-like craft. These are (1) the inertial action of the head weight 145; (2) the gravitational action of the head weight 145; and (2) the tensile force provided by actuator 120.

When the sliding cage 80 is moved to the rear of the craft, the mounting portion 185 of sliding cage 80 slides in the recess of central spar 40 until it strikes cage stop 180. This motion causes a leg 105 to rotate about pins 167 in fulcrum 170 and slide through the tube pivot 165 (see FIG. 10), and therefore extend below the craft. By moving the leg to this position, the aft weight 110 is extended below the wing area. By moving the aft weight 110 below the wing area, the center of gravity of the craft is shifted below the center of lift of the wing. This will allow the craft to exhibit glider-like behavior. Furthermore, placing aft weight 110 below the wing area ensures that the craft will not glide upside down with respect to the horizon.

Figure 7:
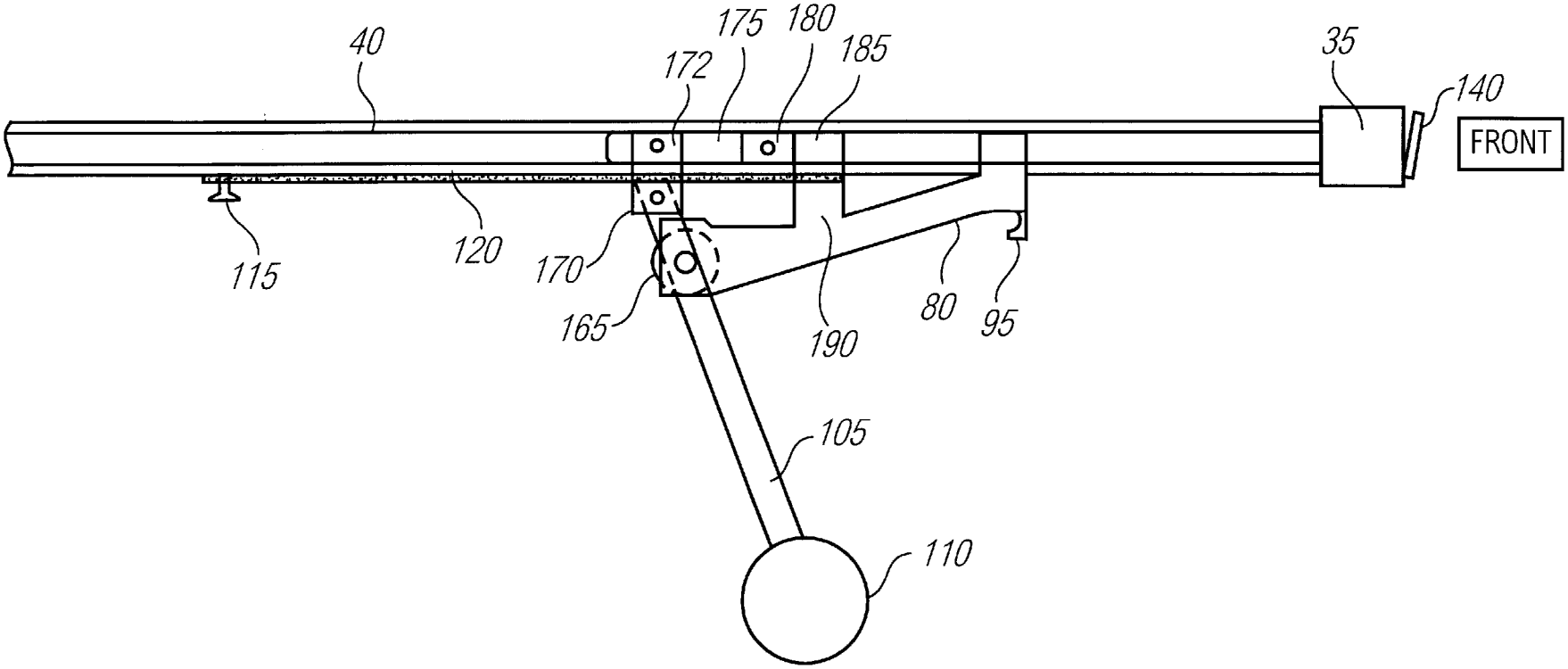
FIG. 7 is a side view of a wing spreading apparatus constructed in accordance with aspects of the present invention with an aft weight in a second position.

It is desirable to allow for different types of flight when the craft converts itself into a glider-like craft. The type of flight can be varied by changing the center of gravity of the craft. The manner in which the present invention provides for changing the center of gravity is discussed with reference to FIGS. 7–9, which show the leg 105 and hence the aft weight 110 at different positions. By placing the aft weight 110 at a different axial position with respect to the craft, the center of gravity of the craft is shifted along the central spar 40. With reference to FIG. 7, to change the center of gravity of the craft, fulcrum holder 172 is moved to different positions within the adjustment slot 175 in central spar 40. By moving the fulcrum holder 172 toward the rear of the craft, the aft weight 110 will not extend as far to the rear of the craft as it might otherwise be able to. By maintaining the center of gravity toward the front of the craft, i.e., keeping the aft weight 110 in a somewhat forward position, the craft will tend to dive after reaching an apogee and having its wings extend by the apparatus of the present invention.

Figure 8:
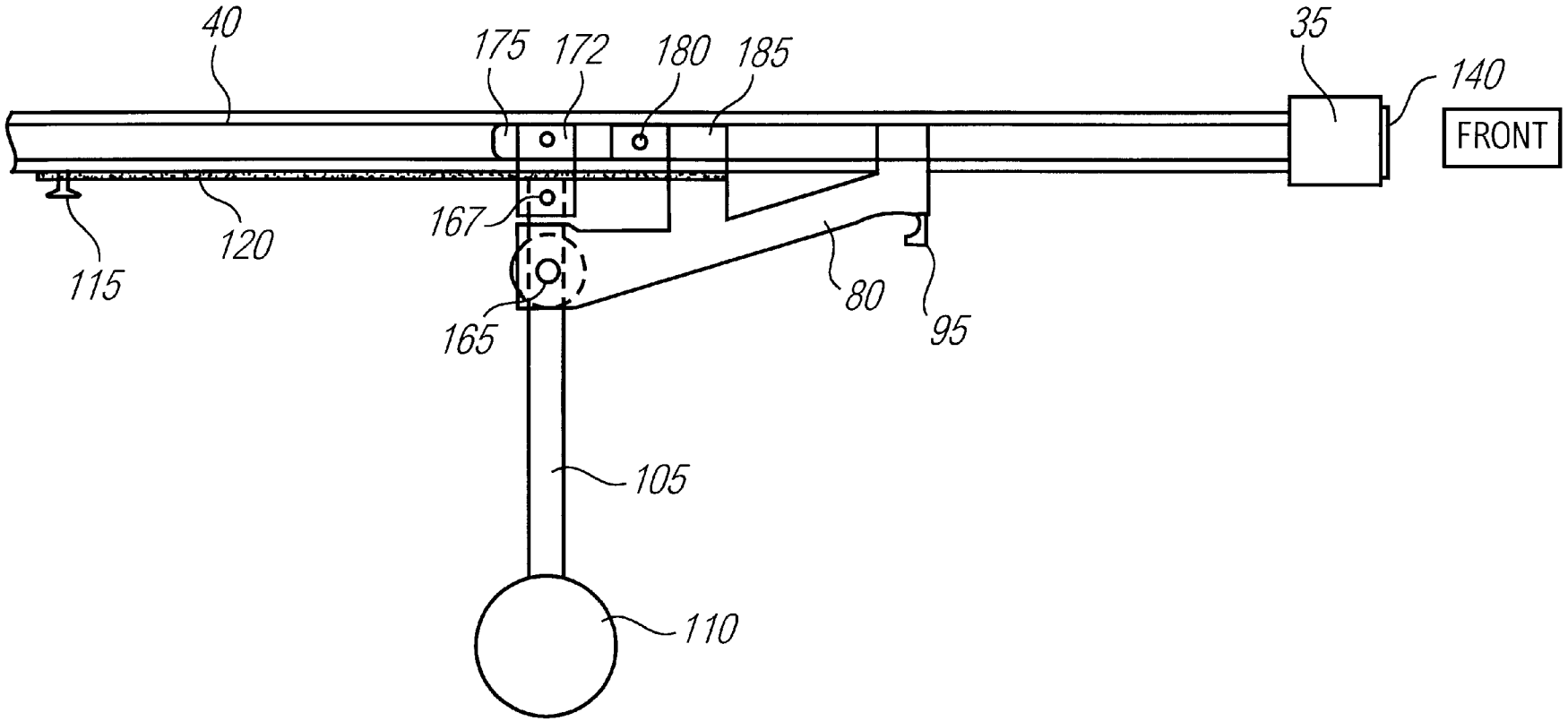
FIG. 8 is a side view of a wing spreading apparatus constructed in accordance with aspects of the present invention with an aft weight in a third position.

With reference to FIG. 8, a second position for aft weight 110 is shown. In the example of FIG. 8, the fulcrum holder 172 is positioned such that when the leg 105 is extended, it is substantially perpendicular to the central spar 40. By placing the leg 105 perpendicular to the central spar 40, the aft weight 110 will be placed substantially immediately below the center of the wing span. Shifting the center of gravity of the craft in this fashion will result in a slowly descending flight.

Figure 9:
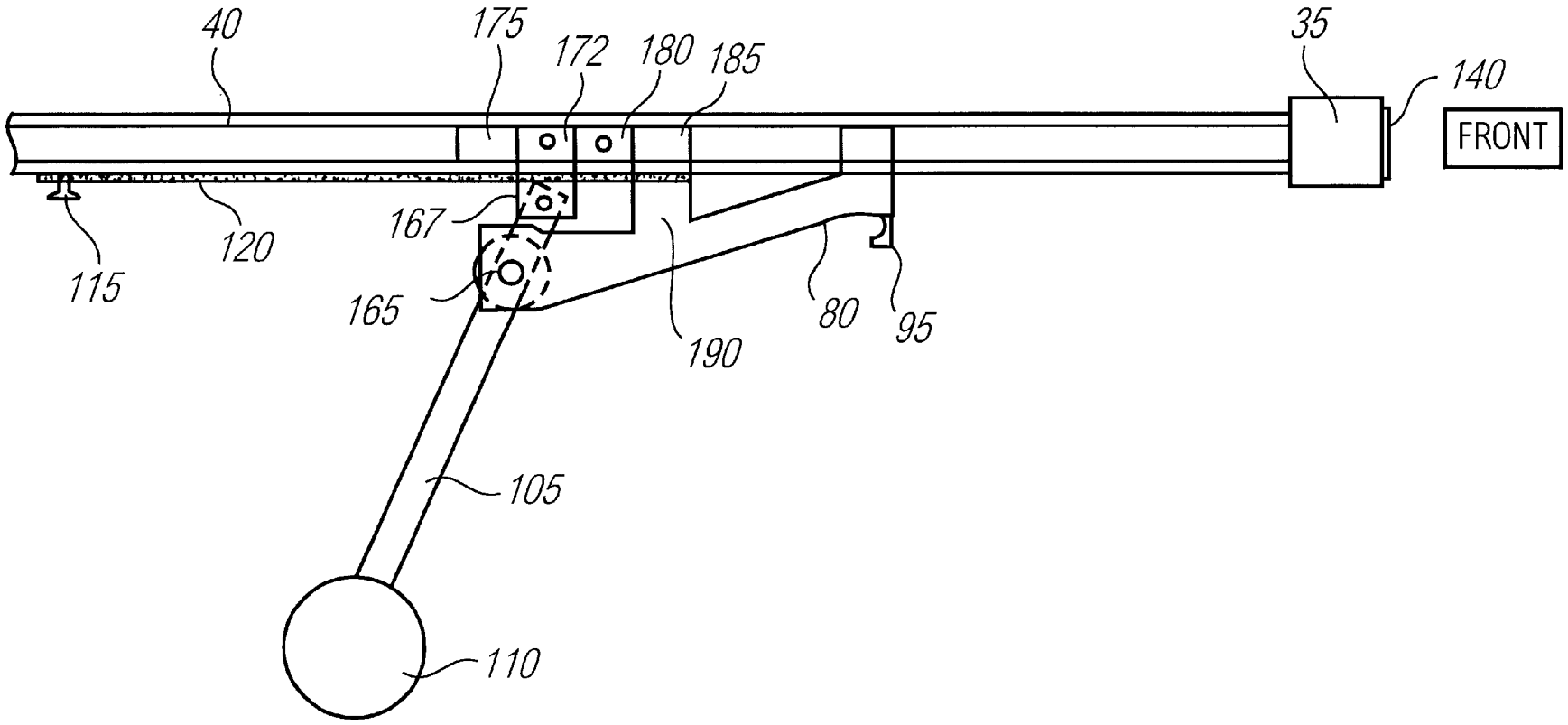
FIG. 9 is a side view of a wing spreading apparatus constructed in accordance with aspects of the present invention with an aft weight in a fourth position.

With reference to FIG. 9, a third position for the aft weight 110 is shown. In the example of FIG. 9, the fulcrum holder 172 is adjusted such that the fulcrum 170 is maintained closer to the front of the craft. This will move the leg 105 such that it will be deflected toward the rear of the craft. By deflecting the leg 105 toward to rear of the craft, the aft weight 110 will be placed farther to the rear of the craft. Shifting the center of gravity of the craft toward to rear of the craft will cause the craft to have a stalling or "porpoising" type of flight.

Figure 14:
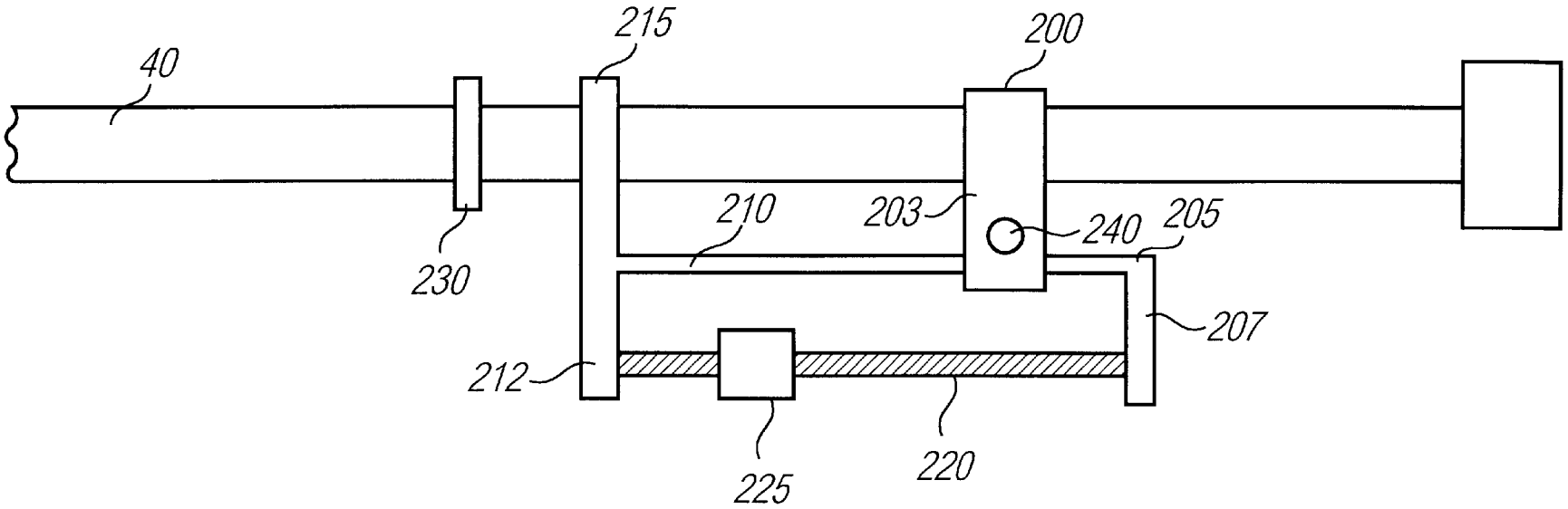
FIG. 14 shows an side view of an alternative center of gravity shifting apparatus constructed in accordance with aspects of the present invention.

With reference to FIG. 14, an alternative center of gravity shifting apparatus will be described. Wing spars, actuators, and the remaining structures of the apparatus are not shown in FIG. 14 to simplify the drawing and to allow for easier viewing of the inventive concepts shown therein. In the embodiment shown in FIG. 14, a first mounting collar 200 is slidably mounted on central spar 40. Mounting collar 200 has an extension 203 which has a first bracket 205 and second bracket 210 installed therein. First bracket 205 extends substantially parallel toward the front of the craft. Second bracket 210 extends substantially parallel toward the rear of the craft. An extension 207 extends substantially perpendicularly from first bracket 205. Extension 207 is preferably integral with first bracket 205. Another extension 212 extends substantially perpendicularly from second bracket 210. Extension 212 is preferably integral with second bracket 210.

Affixed between extensions 207 and 212 of first bracket 205 and second bracket 210 is a threaded arm 220. Mounted on threaded arm 220 is a weight 225. Weight 225 can be placed anywhere along threaded arm 220. A second mounting collar 215 is slidably mounted on central spar 40. Second mounting collar 215 is preferably integral with second bracket 210 and extension 212. Disposed within first mounting collar 200 are apertures 240 (only one aperture 240 is shown) which receive first wing spar 70 and second wing spar 75.

The operation of this embodiment is similar to the embodiments described above. Upon actuation, the center of gravity shifting apparatus moves from the front of the craft to the rear by having first mounting collar 200 and second mounting collar 215 slide along central spar 40. The center of gravity shifting apparatus continues to slide along central spar 40 until it strikes collar stop 230. As discussed, weight 225 can be adjusted to reside anywhere along threaded arm 220. The placement of weight 225 will determine the type of flight the flying apparatus will maintain. When the weight is placed closer to the front of the craft, the craft will tend to dive after reaching an apogee and having its wings extend by the apparatus of the present invention. When the weight is placed in a central position about threaded arm, the craft will experience a slowly descending flight. Finally, by placing weight 225 closer to the rear of the craft will result in a stalling or "porpoising" type of flight.

Thus, a preferred method and apparatus for changing the position of structures on a moving body has been described. While embodiments and applications of this invention have been shown and described, as would be apparent to those skilled in the art, many more embodiments and applications are possible without departing from the inventive concepts disclosed herein. The invention, therefore is not to be restricted except in the spirit of the appended claims. It is intended that all matter contained in the above description and shown in the accompanying drawings shall be interpreted as being illustrative and not limiting. The invention, therefore, is not to be limited except in accordance with the claims.

We claim:

1. A flying apparatus frame comprising:

a central spar having a head piece affixed at a first axial end thereof;

a first dogleg link rotatably mounted in said head piece;

a second dogleg link rotatably mounted in said head piece;

a first head link rotatably mounted in a deflected portion of said first dogleg link, said defelected portion of said first dogleg link extending beyond said first axial end of said central spar;

a second head link rotatably mounted in a deflected portion of said second dogleg link, said deflected portion of said second dogleg link extending beyond said first axial end of said central spar, said first head link pivotably mounted to said second head link at a pivot point, said pivot point extending in front of said first axial end of said central spar;

a head weight disposed in said pivot point;

a first wing spar connected to said first dogleg link;

a second wing spar connected to said second dogleg link, said first wing spar and said second wing spar forming a wing plane when said first wing spar and said second wing spar are extended;

a first wing link pivotably mounted to said first wing spar;

a second wing link pivotably mounted to said second wing spar;

a sliding cage, said sliding cage slidably mounted on said central spar and having said first wing link and said second wing link pivotably mounted thereon, said sliding cage movable during flight from a take off position to a gliding position; and an actuator, said actuator connected between said sliding cage and an anchor point on said central spar.

2. The apparatus of claim 1 wherein said sliding cage is mounted to said central spar by a fulcrum and a cage extension, said fulcrum being slidably disposed in an adjustment slot in said central spar.

3. The apparatus of claim 2 further comprising a leg rotatably mounted on said sliding cage and an aft weight affixed to said leg, said leg being moved substantially adjacent said central spar when said sliding cage is in said take off position, said leg being moved to a substantially non-adjacent position when said sliding cage is in said gliding position, said leg moving in plane substantially perpendicular to said wing plane.

4. The flying apparatus frame of claim 1 wherein said first wing spar is integral to said first dogleg link.

5. The flying apparatus frame of claim 1 wherein said second wing spar is integral to said second dogleg link.

6. The flying apparatus frame of claim 1 wherein said first wing spar is integral to said first dogleg link and said second wing spar is integral to said second dogleg link.

7. The flying apparatus frame of claim 1 wherein said actuator is an elastic band.

8. An apparatus which can transform itself from a first form to a second form when in motion comprising:

a body which can be placed motion, said body comprising a first rotatable leg, a second rotatable leg, and a central member having a head piece at a first end, said first rotatable leg rotatable mounted in said head piece, said second rotatable leg rotatable mounted in said head piece, said apparatus being in said first form when said body is placed in motion;

a first link rotatably mounted in said first rotatable leg;

a second link rotatably mounted in said second rotatable leg, said second link pivotably joined to said first link at a pivot point;

a weight disposed at said pivot point;

an actuator, said actuator connected between a slidable element mounted on said central element and at any point between said slidable element and a second end of said central spar, thereby creating an attractive force between said slidable element and said second end of said central member, and said weight having sufficient mass to resist deceleration of said body, thereby moving said pivot point away from said body and allowing a rotation of said first rotatable leg and said second rotatable leg, said attractive force causing said rotation of said first rotatable leg and said second rotatable leg, thereby transforming said apparatus into said second form.

9. The apparatus of claim 8 wherein said actuator is connected between said slidable element and said second end of said central spar.

10. The apparatus of claim 8 wherein said actuator is an elastic band.

* * * * *